United States Patent [19]

Faulkner, III

[11] Patent Number: 4,659,016

[45] **Date of Patent: * Apr. 21, 1987**

[54] HOT-MELT DISPENSER WITH AIMABLE NOZZLES

[75] Inventor: W. Harrison Faulkner, III, Pacific Grove, Calif.

[73] Assignee: Slautterback Corporation, Monterey, Calif.

[ * ] Notice: The portion of the term of this patent subsequent to Jul. 29, 2003 has been disclaimed.

[21] Appl. No.: 664,618

[22] Filed: Oct. 25, 1984

Related U.S. Application Data

[63] Continuation-in-part of Ser. No. 493,710, May 11, 1983, Pat. No. 4,602,741.

[51] Int. Cl.[4] ..... B05B 1/14; B05B 1/24

[52] U.S. Cl. ..... 239/135; 118/411; 222/146.2; 239/550

[58] Field of Search ..... 239/600, 550, 551, 562, 239/566, 132, 134, 135, 498, 504, 596, 598, 568, 587; 118/315, 410, 411, DIG. 3; 222/146.1, 146.2, 146.5, 146 R, 146 H; 53/383

[56] References Cited

U.S. PATENT DOCUMENTS

| | | | |
|---|---|---|---|
| 535,669 | 3/1895 | Burt | 239/550 |
| 919,737 | 4/1909 | Loomis | 239/498 X |
| 1,181,145 | 5/1916 | Larson | 239/498 X |
| 2,299,259 | 9/1940 | Sites | 239/562 |
| 2,998,934 | 9/1961 | Broughton | 239/550 X |
| 3,126,574 | 3/1964 | Fox | 239/560 X |
| 3,327,680 | 6/1967 | Talbot | 118/411 X |
| 3,344,767 | 10/1967 | Talarico | 118/2 |
| 3,348,520 | 10/1967 | Lockwood | 118/2 |
| 3,407,023 | 10/1968 | Hirschberg et al. | 239/600 X |
| 3,608,793 | 9/1971 | VanLobenSels | 222/490 |
| 3,722,821 | 3/1973 | Jaeger et al. | 239/133 |
| 3,877,510 | 4/1975 | Tegtmeir et al. | 239/550 X |
| 3,931,788 | 1/1976 | Gadd et al. | 118/8 |
| 3,942,687 | 3/1976 | Walus et al. | 222/146.5 |
| 3,974,964 | 8/1976 | Pearce et al. | 239/600 X |
| 3,981,122 | 9/1976 | Johnson | 118/411 X |
| 3,981,123 | 9/1976 | Flanagan | 118/411 X |
| 4,050,633 | 9/1977 | Lowison | 239/600 X |
| 4,261,516 | 4/1981 | Tellman | 239/498 X |
| 4,287,408 | 9/1981 | Wilson | 219/475 |
| 4,334,637 | 6/1982 | Baker et al. | 222/146 |
| 4,373,132 | 2/1983 | Vartanian | 219/421 |
| 4,474,169 | 10/1984 | Katnik | 239/600 X |
| 4,602,741 | 7/1986 | Faulkner et al. | 239/135 |

FOREIGN PATENT DOCUMENTS

| | | | |
|---|---|---|---|
| 1021574 | 2/1953 | France | 239/551 |
| 288055 | 8/1931 | Italy | 239/498 |
| 205207 | 7/1922 | United Kingdom | 239/587 |
| 728819 | 3/1955 | United Kingdom | 239/600 |

*Primary Examiner*—Andres Kashnikow
*Assistant Examiner*—Kevin Patrick Weldon
*Attorney, Agent, or Firm*—Thomas Schneck

[57] ABSTRACT

A nozzle assembly for use with a hot-melt dispensing head having a manifold with a lengthwise passageway opening into plural, spaced-apart nozzle inserts for dispensing hot melt. The nozzles themselves are aimable over a wide range of angles and are replaceable. In one configuration the nozzle assembly has a T shape with the nozzles on a side of the T top distal to the dispenser head. In another configuration, the nozzle assembly has a Y shape with the nozzles on a side of the Y top facing the dispenser head. The two configurations may be spaced opposite each other to form a box sealing station.

15 Claims, 17 Drawing Figures

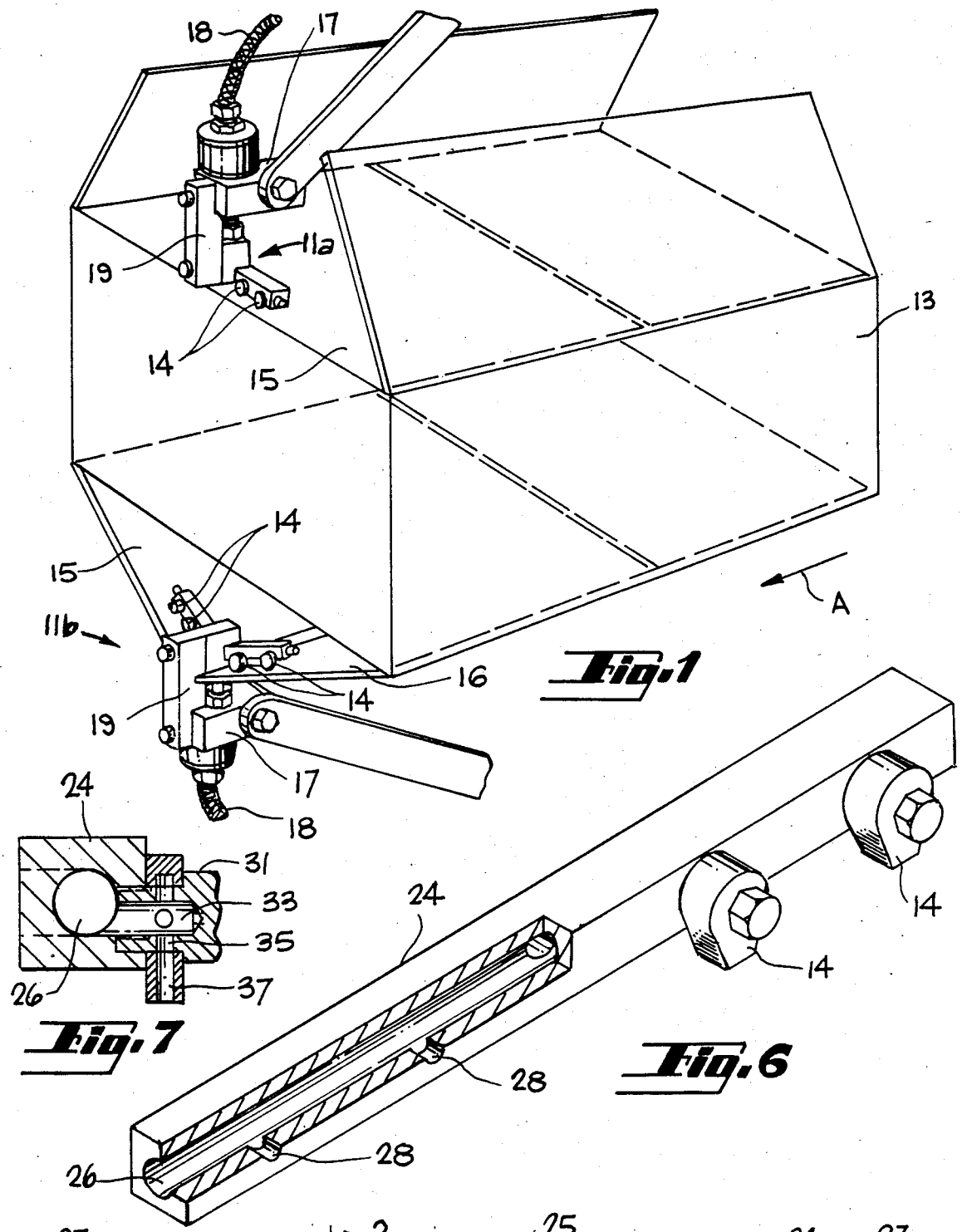
Fig. 1
Fig. 7
Fig. 6
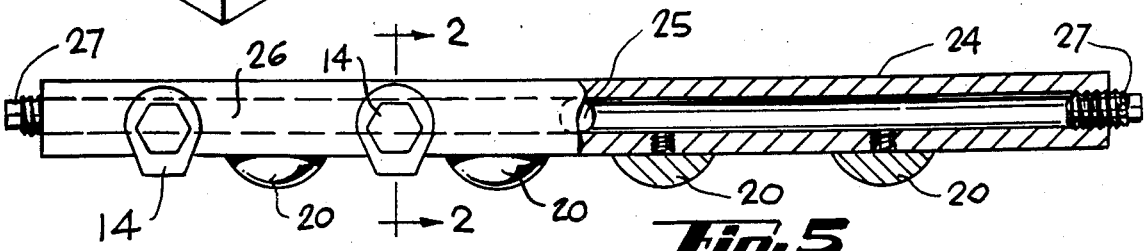
Fig. 5

HOT-MELT DISPENSER WITH AIMABLE NOZZLES

CROSS REFERENCE TO RELATED APPLICATION

This is a continuation-in-part of prior application Ser. No. 493 710 filed May 11, 1983 now U.S. Pat. No. 4,602,741.

TECHNICAL FIELD

The invention relates to a nozzle assembly for a hot-melt adhesive dispenser and more particularly to a multi-orifice nozzle assembly having aimable nozzles for the low pressure dispensing of hot-melt adhesive.

BACKGROUND ART

Hot-melt adhesives are used extensively for case and carton sealing on automated packaging machinery. Inherent in hot-melt adhesive dispensers are the problems of soiling, drooling and stringing between applications. The typical solutions to these problems are the employment of (1) nozzle assemblies containing pressure activated valves such as that seen in U.S. Pat. No. 3,608,793 and/or (2) small diameter nozzle orifices. Both of these solutions require the use of high pressure equipment, either to insure activation of the valve or to supply a sufficient amount of adhesive to the carton flaps through the small diameter orifices. High pressure equipment is more expensive than that used in low pressure applications and at the same time it is potentially dangerous since a rupture in the equipment could spray melted adhesive in any direction.

The use of large orifices on the nozzles of low pressure equipment eliminates the problems of char particle clogging that result from degraded adhesive found in capillary nozzles and which necessitates use of filters with the high pressure apparatus. However, large diameter orifices may cause problems of drooling from the nozzle tips between applications because of the large volume of adhesive material past the cutoff valve. Decreasing the size of the bore of the passageway supplying adhesive to the nozzle tip would interfere with adequate adhesive flow under low pressure conditions. U.S. Pat. No. 3,348,520 and U.S. Pat. No. 3,608,793 are typical of prior art hot-melt adhesive dispensers used in the automated packaging industry. Both of these patents use high pressure equipment to initiate pressure-activated nozzle valves.

U.S. Pat. No. 3,981,123 shows a hot-melt adhesive apparatus which applies adhesive to the top and bottom flaps of a carton. A large portion of the elements that make up the apparatus are present only for the purpose of aligning the box for proper adhesive application. The apparatus must be realigned each time a different sized box enters the assembly line.

An object of the present invention was to provide a reliable, uncomplicated hot-melt adhesive dispenser for application on an automated assembly line.

A further object was to devise a multi-orifice nozzle assembly that could be used with low-pressure hot-melt adhesive dispensers and that would maintain clean nozzle cutoff between applications without drips, drools, or leaks from the nozzle tip.

DISCLOSURE OF INVENTION

The above objects were met by the development of a multi-orifice nozzle manifold assembly, which can be attached directly to a low pressure hot-melt dispensing head. Such a head normally contains heaters, a pumping mechanism and a valve for delivering hot melt into a nozzle manifold assembly having a lengthwise passageway. The diameter of the passageway for the adhesive through the manifold to a plurality of aimable nozzles is kept to a critical size to allow adequate adhesive flow while preventing nozzle drool during cutoff periods. The nozzles may be aimed over a wide range of angles and are replaceable Interspersed between the nozzle tips are steel wear bars which prevent direct contact of the nozzle orifices with the application surface. The design of the invention permits use of larger orifices in the nozzle tips, thereby eliminating problems of clogging and the need for filters to remove char particles.

BRIEF DESCRIPTION OF THE DRAWINGS

FIG. 1 is a perspective view showing the apparatus of the present invention in a carton sealing configuration for the application of hot-melt adhesive to carton flaps.

FIG. 5 is a partially cutaway front view of a dispensing bar with nozzle tips and wear bars.

FIG. 6 is a partially cutaway perspective view of the dispensing bar of FIG. 5.

FIG. 7 is a sectional side view of a nozzle tip inserted into a dispensing bar, taken along 7—7 of FIG. 5.

BEST MODE FOR CARRYING OUT THE INVENTION

Figure 2:
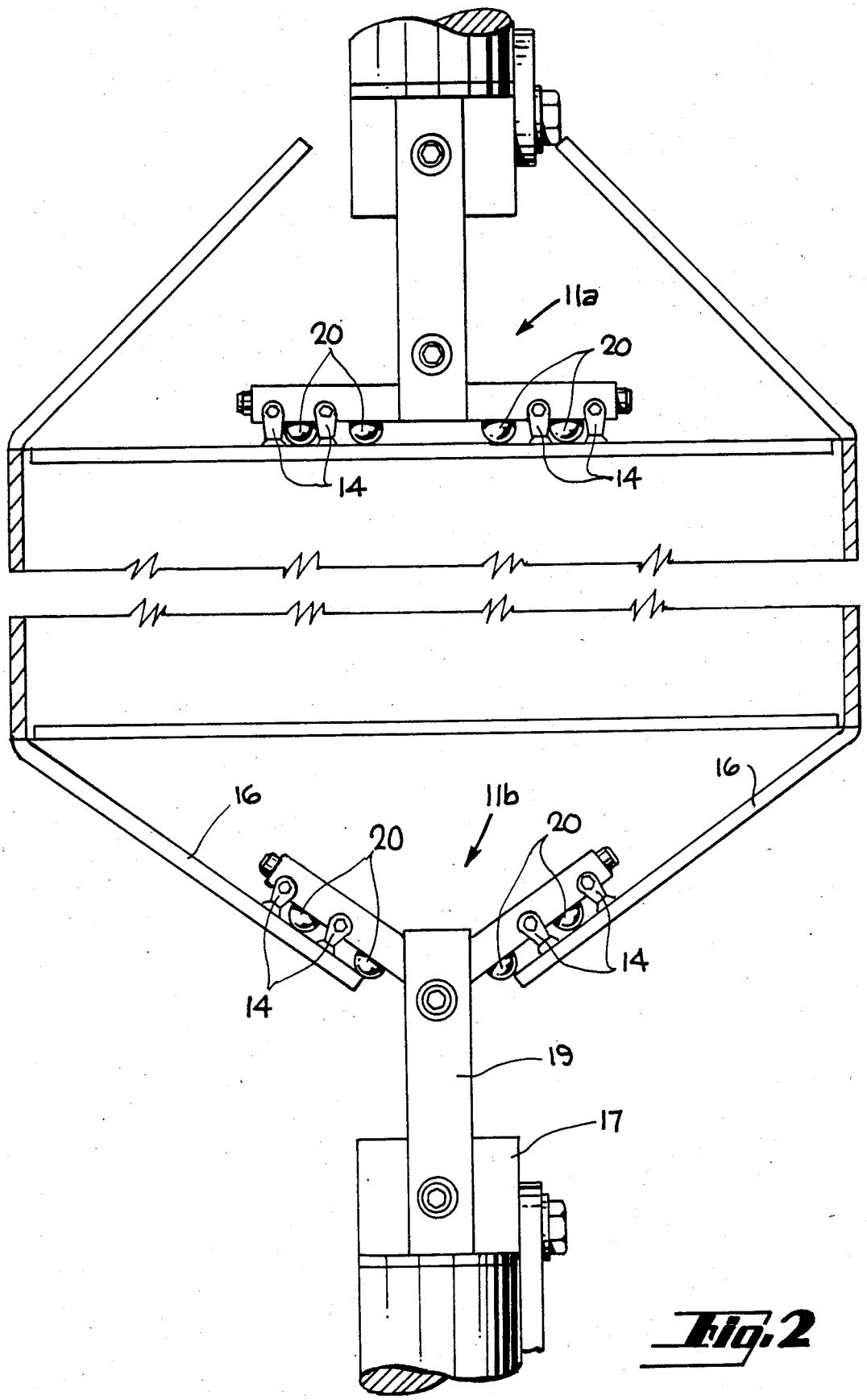
FIG. 2 is a front view of the apparatus of FIG. 1.

The present invention for the dispensing of hot-melt adhesive material is a nozzle manifold assembly having nozzles of larger orifice diameter located on a dispensing bar with both material and heat conducting paths to a heated low pressure hot-melt dispenser head. The nozzle assembly is designed to ensure that sufficient flow of the adhesive is maintained under low pressure delivery conditions of below 150 pounds per square inch, while preventing the tendency of melted adhesive to drool from the larger diameter orifice in the nozzle tips.

With reference to FIG. 1, two embodiments of the nozzle manifold assembly 11*a* and 11*b* of the present invention are shown in use in an automatic packaging assembly line. As a carton 13 moves along rollers (not shown) in the direction of the arrow A, hot-melt adhesive is dispensed from the nozzles 14 to the outside surfaces 15 of the top minor flaps of the box and to the inside surfaces 16 of the bottom major flaps.

The nozzle manifolds are attached to fixed position heated hot-melt dispenser heads 17 through which hot-melt adhesive passes by means of solenoid valves from hoses 18 connected to melting tanks, not shown. Heat transfer blocks 19 conduct heat from the heated dispenser heads 17 to the nozzle manifolds. These blocks should be sufficiently massive and thermally conductive to be a heat reservoir which will maintain the temperature at the nozzles with a temperature drop relative to the head of 40°-50° F., without a separate heat source for the blocks. Moreover, the limited drop can be maintained for short times in the event the head momentarily loses its heat source.

With reference to FIG. 2 the top-apply manifold assembly 11*a* is shown as an inverted T-shape configuration with nozzles 14 placed on the front side of the dispensing head. The bottom-apply manifold assembly 11*b* is of a Y-shape configuration with the nozzles 14 facing toward the dispenser head 17, thus facilitating contact with the inner surface 16 of the bottom major flaps of the box. FIG. 2 shows that direct contact of the box surface with the aimable, adhesive dispensing nozzles 14 is prevented by interspersing semicircular wear bars 20 which ride along the box surface.

Figure 3:
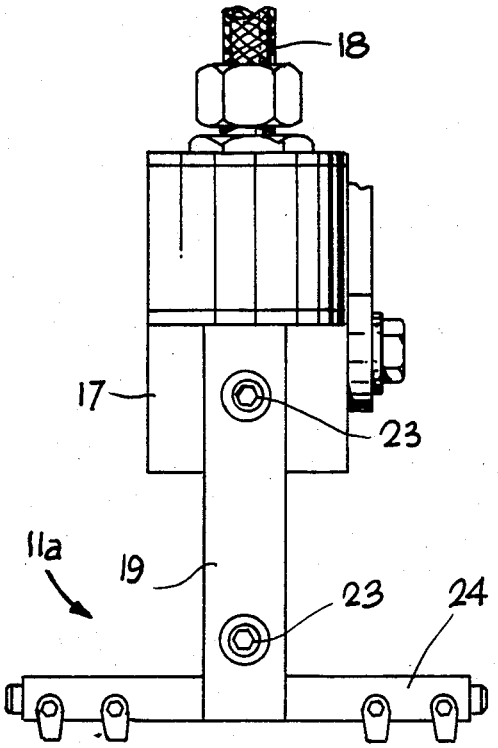
FIG. 3 is a plan view of the upper nozzle manifold assembly and head of FIG. 2.
Figure 4:
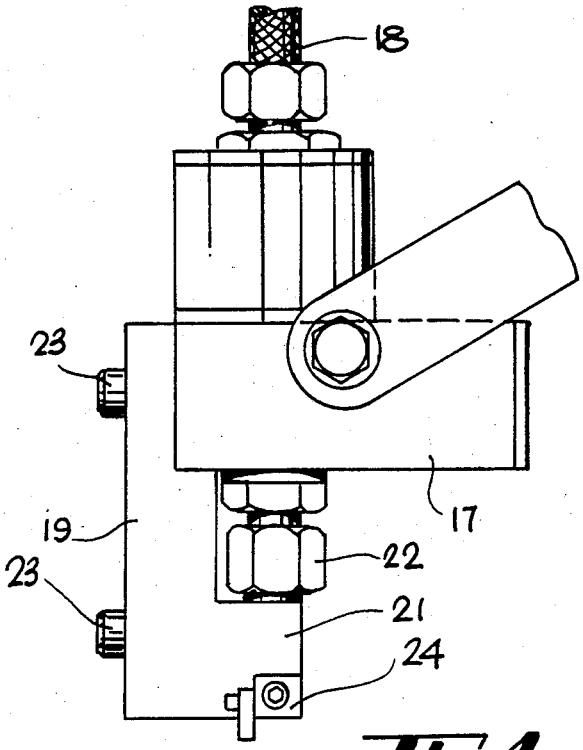
FIG. 4 is a side view of the manifold assembly and head of FIG. 3.

FIGS. 3 and 4 show details of the connections between the dispenser head 17 and the nozzle manifold assembly 11*a*. An important element of the nozzle manifold assembly is shown in FIGS. 3 and 4. In order to maintain the adhesive in a less viscous melted condition which may be dispensed under lower pressure, it is necessary to minimize any cooling during the passage of the hot adhesive through the manifold. In addition, during periods between application, when the adhesive is held in the manifold, it is necessary to maintain it in a heated condition. To accomplish this purpose, a high thermal conductivity, metal, heat transfer block 19, made of a material such as aluminum, is placed in heat conducting relationship between the heated dispenser head 17 and a brass nozzle manifold inlet section 21, shown in FIG. 4. The heat transfer block 19 provides a heat flow path that is separate from the adhesive flow path, thereby avoiding the extra expense and complexity that would result from adding a second heating unit to the nozzle manifold assembly. Any variation in tolerances of sizes of the interconnected heat transfer block and inset section is adjusted by the swivel nut 22. Screws 23 are used to connect the heat transfer block 19 to both the head and the inlet.

FIG. 4 also shows the adhesive flow path of the nozzle manifold assembly 11*a*. The inlet section of the manifold 21, having a 0.089 inch diameter hollow center bore, not shown, is joined to the dispenser head 17 by means of the swivel nut 22 in a direct hot-melt material dispensing line with the inlet hose 18. The swivel nut 22 allows tolerances for a leak-free attachment of the inlet section of the manifold to both the dispenser head 17 and to the heat transfer block 19.

The inlet section 21 is connected to the mid-section of a rectangularly shaped dispensing bar 24, shown in FIG. 5. The dispensing bar has an 0.089 inch bore 25, which lines up with the center bore of the inlet section and a longitudinal 0.089 inch bore 26, which opens to the outside through multiple holes into which nozzle heads 14 are inserted. At both ends of the longitudinal or lengthwise inner bore 26, screws 27 are placed to facilitate cleaning of the nozzle manifold interior. Interspersed between the nozzles on the dispensing bar are semicircular wear bars 20.

With reference to FIG. 6, the holes 28 that open the 0.089 inch diameter bore to the outside can be seen. The rectangular cross-sectional shape of the dispensing bar 24 provides maximum strength while rendering a minimization of thermal radiation surface between the surrounding air and the hot-melt-adhesive-containing bores. The diameter of the passageway through this dispensing bar is preferably 0.089 inch. Smaller diameters would not permit an adequate adhesive flow under low pressure delivery conditions. A larger diameter would result in poor cutoff of adhesive flow and increase the tendency of the nozzle to drool. A viable range of diameters is 0.079 to 0.120 inches.

FIG. 7 shows a sectional side view of the dispensing bar 24 and a nozzle taken along lines 7—7 of FIG. 5. A bolt 31 holds the nozzle head assembly in place. A primary orifice 33 joins the passageway 26 through the dispensing bar to a secondary orifice 35. The secondary orifice 35 lines up with the nozzle head orifice 37. The diameters of the nozzle assembly orifice 33, 35 and 37 are less than the diameter of the bore 26 through the dispensing bar 24 but they are, nevertheless, relatively large. Large diameter orifices are employed to significantly reduce nozzle plugging due to adhesive contamination. Small diameter orifices tend to plug frequently if in-line filters are not employed. Opening up the orifice to at least 0.040 inches significantly reduces, and in many cases, totally eliminates plugging, without the use of filters. The reason for this is that the cross-sectional area of the opening increases on a squared basis (e.g., a 0.040 inch nozzle area is 16 times larger than a 0.010 inch nozzle). A preferred range of nozzle orifice openings is between 0.010 and 0.090 inches in diameter.

The nozzle assembly bolt 31 contains a plurality of secondary orifices 35, permitting the nozzle to be aimed in a variety of positions ranging from 0° to 180°, but at least between 60° to 120°, 0° and 180° being taken as a line parallel to the lengthwise dimension of the dispensing bar. This option allows a user to change the location of the tracks of adhesive which are dispensed along the flaps of the carton. Without aimable nozzles, the only way the track locations could be changed would be the replacement of the dispensing bar 24. The construction of the nozzle head assembly 14 also permits a user to disassemble the nozzles for cleaning or replacement purposes.

The nozzle head assembly 14 should be made of steel for long wearing durability. The swivel nut conneection piece 22, inlet section 21 and dispensing bar 14 may be fashioned from brass. The wear bars 20 are made of steel and are positioned to prevent contact of the nozzle with the application surface.

Figure 8:
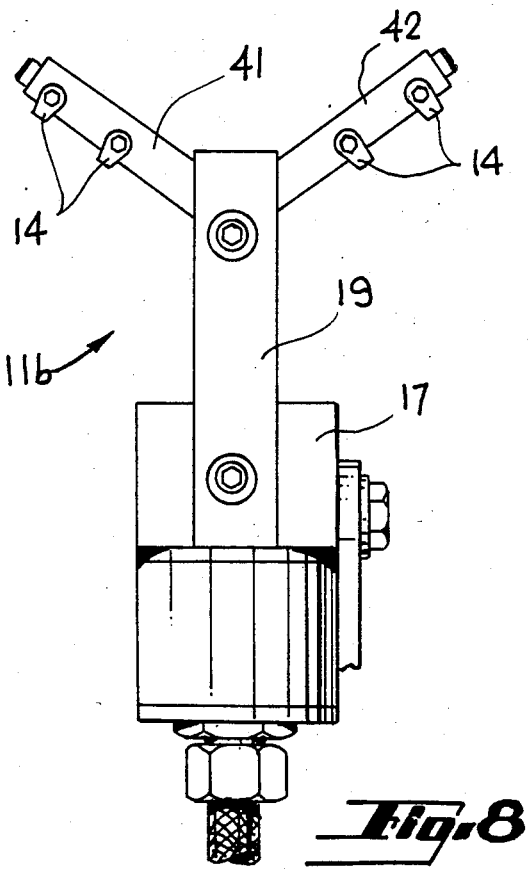
FIG. 8 is a plan view of the lower nozzle manifold assembly and head of FIG. 2.
Figure 9:
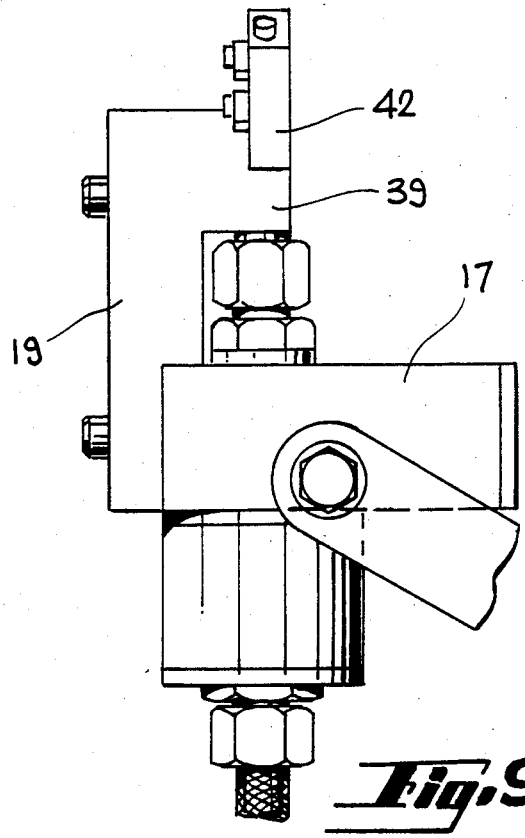
FIG. 9 is a side view of the manifold of FIG. 8.

Another nozzle manifold assembly, for use in applying adhesive to the inner edges of the major flaps at the bottom of a container, is shown in FIGS. 8 and 9. The dispenser bar of this Y-shaped applicator assembly is split into two sections and joined to an inlet section 39, which has a hollow 0.089 inch diameter center bore in material transfer relationship with the dispenser head 17. The center bore diverges into two bores separated by angles of usually 110° or 130°. Each of the two sections of the dispensing bar 41 and 42 are joined at one of the two outlets of the diverging bores of inlet section 39. Center bores of 0.089 inch in each bar section continue the passageway for the melted adhesive to flow out of nozzles 14 placed on the side of the dispenser bars facing toward the dispenser head 17. By this arrangement, melted adhesive may be applied to the inside edges of the partially opened bottom major flaps of the container. This embodiment has similar nozzle inserts and wear bars as previously described for the top-apply nozzle manifold assembly. Likewise, a heat transfer block, 19, as previously described, is employed to provide a heat flow path that is separate from the adhesive flow path.

Figure 10:
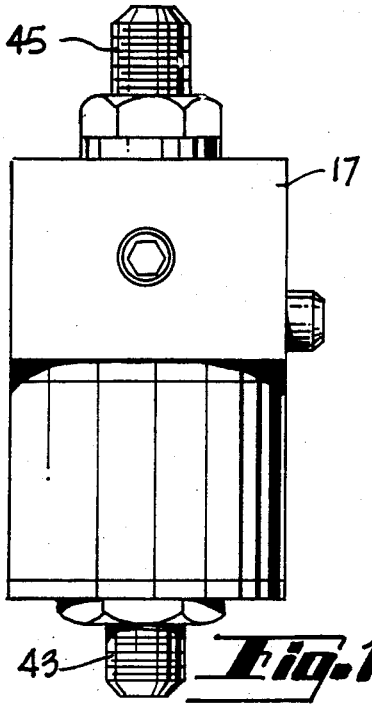
FIG. 10 is a front view of a heated dispenser head with associated coupling
Figure 11:
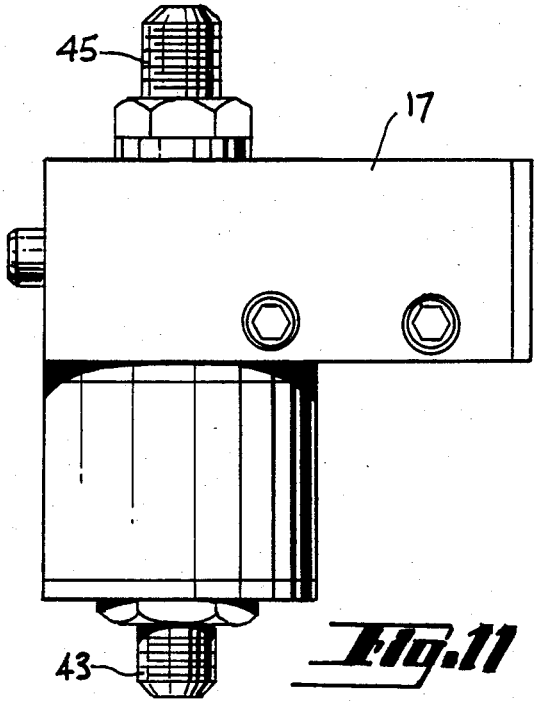
FIG. 11 is a side view of the apparatus of FIG. 10.

FIGS. 10 and 11 show the heated dispenser head 17 and its related coupling. The hot-melt adhesive enters at inlet 43. After passing through the heated dispenser head 17 the adhesive exits through outlet 45. Dispenser heads are well known and are commercially available. The heads contain at least one valve and a heater unit. The apparatus as shown in FIGS. 10 and 11 remains the same for all embodiments of the nozzle manifold assembly.

Figure 12:
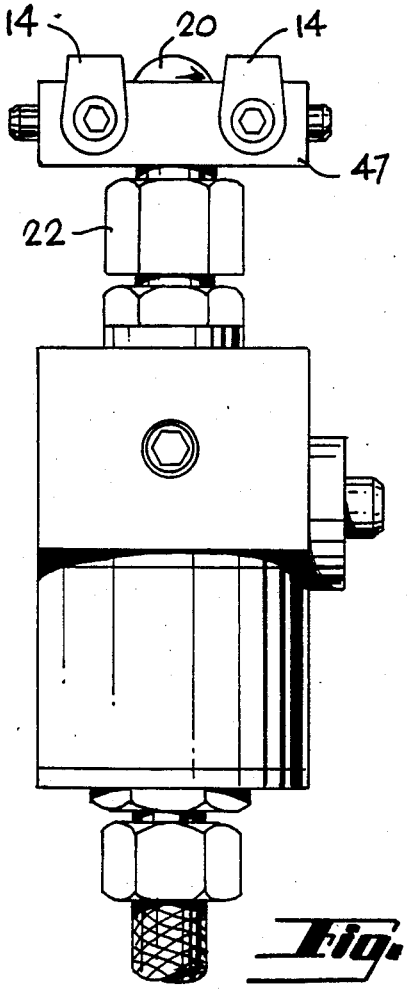
FIG. 12 is a front view of an upper nozzle manifold assmbly having two nozzle tips
Figure 13:
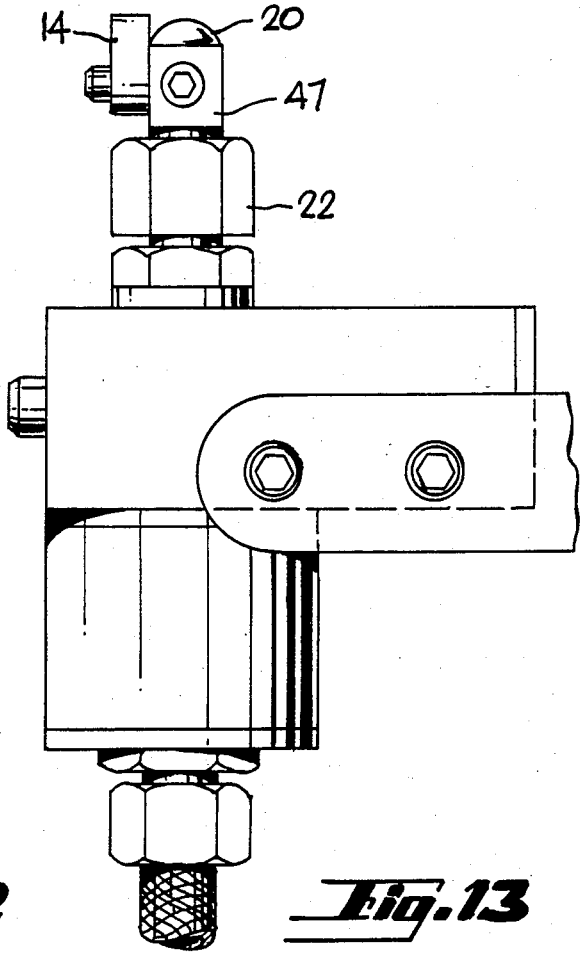
FIG. 13 is a side view of the apparatus of FIG. 12.

With reference to FIGS. 12 and 13, a second embodiment of the top-apply nozzle manifold assembly is shown. A swivel nut 22 and a dispensing bar 47, having only two, closely spaced, aimable nozzles 14 and one wear bar 20, is added to the apparatus of FIG. 11. The nozzles 14 should be no further than one inch from each other. If a dispensing bar contains only two nozzles but the nozzles are positioned at a distance greater than one inch from each, the preferred configuration is to add a heat transfer block and an inlet section to the nozzle manifold assembly of FIG. 12. The additions are preferred because the likelihood of adhesive cooling increases as the distance the adhesive must travel to the nozzle increases.

Figure 15:
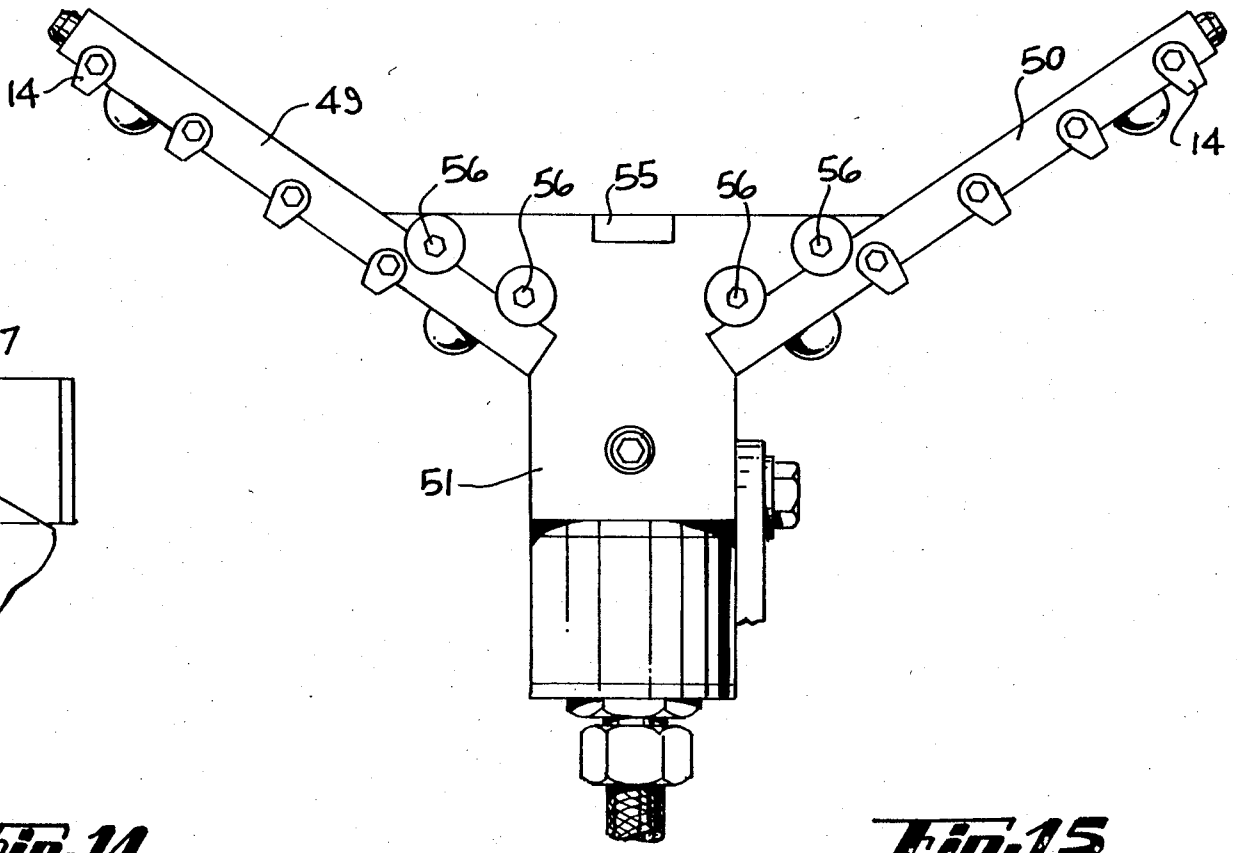
FIG. 15 is a front view of the apparatus of FIG. 14.
Figure 14:
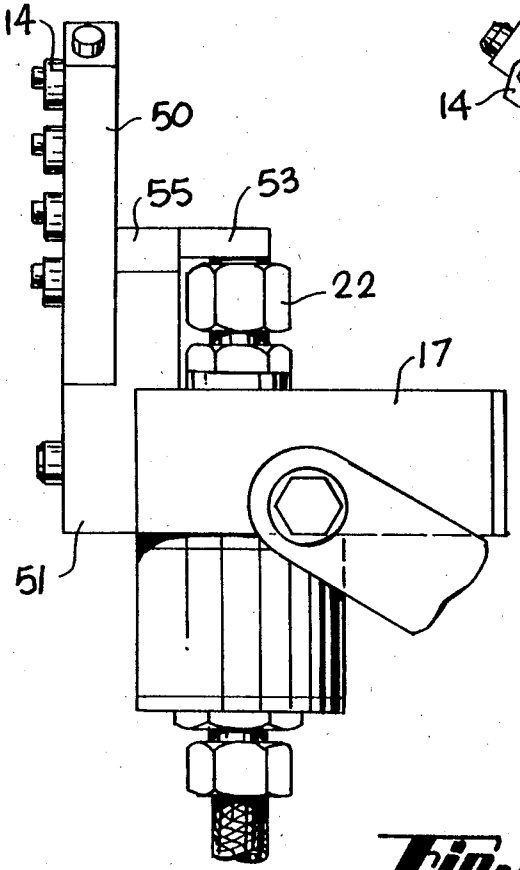
FIG. 14 is a side view of a lower nozzle manifold assembly having eight nozzle tips.

Referring now to FIGS. 14 and 15, a key design consideration for nozzle manifold assemblies having expanded dispensing bars 49 and 50 is to maintain the proper temperature at the most external nozzles 14. A cool dispensing bar or nozzle tip results in poor adhesive cutoff and stringing hot melt. A heat transfer block 51 transfers enough heat to the external nozzles 14, experiencing only a 40 or 50 degree temperature drop, and at the same time is in keeping with a second design consideration—avoidance of complicating the assembly with a second heating device. To the apparatus of FIG. 11, a swivel nut 22 is provided, as seen in FIG. 14. The adhesive path continues through the swivel connection to a turn block 53. The turn block 53 contains a 0.089 inch passageway, not shown, which delivers the adhesive to an inlet section 55. From the inlet section 55 the adhesive drops down into a longitudinal bore, not shown, that travels through the heat transfer block 51 from the dispensing bar 49 to the dispensing bar 50. The bore through the heat transfer block 51 is located just below the inlet section 55 as viewed in FIG. 15 and provides adhesive to the dispensing bars 49 and 50 close to the lowermost nozzles of the two bars. The heat flow path, on the other hand, travels from the dispenser head 17, through the heat transfer block 51, to the dispensing bars 49 and 50. To facilitate cleaning or replacement of the expanded dispensing bars, bolts 56 may be removed, thereby freeing the bars 49 and 50 from the rest of the assembly.

Figure 17:
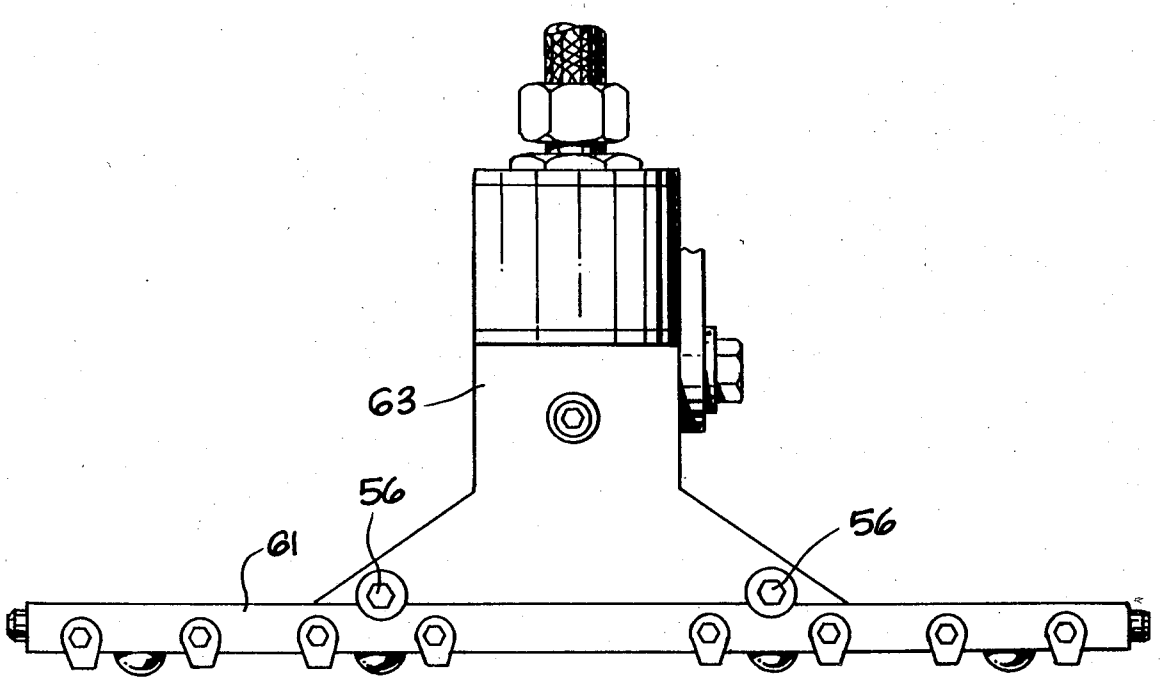
FIG. 17 is a front view of the apparatus of FIG. 16.
Figure 16:
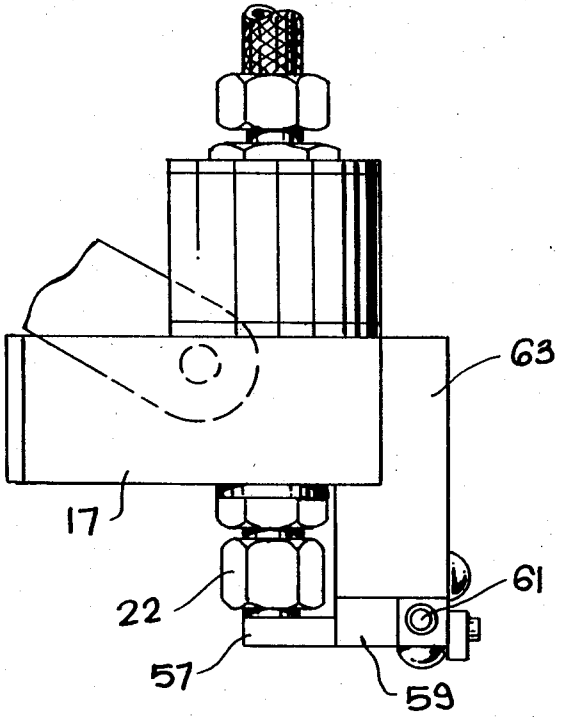
FIG. 16 is a side view of an upper nozzle manifold assembly having eight nozzle tips.

Just as the Y-shaped manifold assembly can be expanded for sealing large cartons, so too the T-shaped assembly can be extended. The adhesive flow path of such an assembly is a simplified version of the flow path in FIG. 14. With reference to FIGS. 16 and 17, the adhesive comes from the dispenser head 17 and the swivel nut connection 22, through a turn block 57 and an inlet section 59, to the extended dispensing bar 61. The greater the length of a dispensing bar, the greater the concern of adhesive cooling as it works its way through a low pressure applicator. For this reason a heat transfer block 63 having flared ends is employed. The flared ends of the block 63 increase the area of surface contact between the block and the dispensing bar 61. It is preferred that bolts 56 be utilized to permit a user to remove the extended dispensing bar 61 for cleaning or replacement.

Each nozzle manifold assembly cited above may be used independently or the top-apply and bottom-apply eembodiments may be combined as in FIG. 1 in an automated assembly line for sealing boxes. As the boxes pass down a conveyor belt the bottom outside flaps are folded partially and the top inside minor flaps are folded in. As the box moves along, it is contacted by the stationary mounted top-apply and bottomn-apply nozzle assemblies. Hot-melt adhesive is dispensed from the nozzle tips, falling on the flaps in parallel strips. It is possible to control the length of the strips by a valving mechanism in the dispensing head so as to deposit short or long strips or dots of adhesive. It is possible to control the position of the strips by the choice of dispensing bars and by aiming the nozzles of the dispensing bar.

Material is retained in a melted condition between applications by the thermodynamic contact of the heat transfer bar with the heated dispenser head and the dispensing bar. The size of the bore through the dispensing bar prevents drooling from the larger nozzle orifices that are required for lower pressure dispensing while maintaining an adequate flow. Thus, the present invention permits dispensing of hot-melt adhesive at low pressures—150 psi and lower.

I claim:

1. An improved nozzle assembly for use with a low pressure, heated dispenser head for hot-melt material, the improvement comprising, a high heat conductivity, passive metal block connected to a heated hot-melt dispenser head, said metal block providing a heat flow path from said heated dispenser head, through said metal block, a nozzle manifold in thermal contact, via said metal block, with said heated dispenser head, the nozzle manifold having a dispensing section with nozzles operable at low pressure connected thereto, and a passageway, distinct from said heat flow path, through said manifold connecting said heated dispenser head to the mainfold at an inlet section, said passageway then continuing through said manifold to the nozzles of the dispensing section of the manifold for the dispensing of the hot-melt material, the angle over which said nozzles are aimable being in the range of from 60 to 120 relative to the lengthwise direction of said passageway.

2. The apparatus of claim 1 wherein the dispensing section of the nozzle manifold includes wear bars interspersed between said aimable nozzles.

3. The apparatus of claim 1 wherein the aimable noz-±les have orifice openings in the range between 0.010 and 0.090 inches diameter.

4. The apparatus of claim 1 wherein the dispensing section of said manifold is perendicular to the inlet section, a T configuration.

5. The apparatus of claim 1 wherein the dispensing section is formed of bard in a Y configuration in relation to the direction of the metal block.

6. The apparatus of claim 4 wherein the dispensing section is of a length in excess of 7 inches and the metal block is flared at an end of said block proximate to the inlet section and dispensing section.

7. The apparatus of claim 1 wherein the plurality of aimable nozzles each comprises a bolt and a nozzle head, said bolt having a first orifice matching said orifices of the dispensing section and having a plurality of second orifices originating from said first orifice, said nozzle head having a hollow center through which said bolt is placed and an elongation substantially perpendicular to said hollow center, said elongation having a single orifice from said hollow center of said nozzle head to the outside, the first orifice, one of said second orifices, and the single orifice combining to form a passageway to the outside for material in the dispensing section.

8. In an automated assembly line for the hot-melt adhesive sealing of cartons, in which the adhesive is dispensed from a heated dispenser head, the improvement which comprises, a multi-orifice nozzle manifold assembly means connected to a hot-melt dispenser head having aimable nozzles operable at low pressure and having an inverted T-shape with a top and a base, the nozzles on a side of the T-top distal to the dispenser head for applying hot-melt to the top minor flaps of a carton and a second multi-orifice nozzle manifold assembly means connected to said hot-melt dispenser head having aimable nozzles operable at low pressure and having a Y-shape with a top and a base, the nozzles on a side of the Y-top facing the dispenser head for applying hot-melt to the inside of the bottom major flaps of a carton, each nozzle manifold in heat transfer contact with a passive high heat conductivity metal block, and a heated hot-melt dispenser head connected to the metal block in heat transfer relation, the metal block providing a heat flow path distinct from said manifold from said heated dispenser head to each nozzle manifold.

9. The system of claim 8 wherein said aimable nozzles are aimable over an angle in the range from 60° to 120° relative to the top of said T-shaped and Y-shaped manifold assembly means.

10. The system of claim 8 wherein each of said aimable nozzles comprises a bolt and a nozzle head, said bolt having a first orifice communicating with hot-melt in one of said manifold assembly means and having a plurality of second orifices originating from said first profoce. saod nozzle head having a hollow center through which said bolt is placed and a single orifice from said hollow center to the outside, the first orifice, one of said second orifices and the single orifice combining to form a passageway to the outside for hot-melt in the one said manifold assembly means.

11. The system of claim 8 wherein both said manifold assembly means has wear bars interspersed between said aimable nozzles.

12. An improved nozzle system for the sealing of the top and bottom major and minor flaps of a moving container, with hot-melt adhesive material of the type wherein said material is dispensed through an applicator nozzle from a heated holding holding tank by means of a remote controlled valving mechanism on a heated dispenser head wherein the improvement comprises, a stationary multi-orifice nozzle manifold having an inverted T-condiguration with a top and a base and with aimable nozzles on a side of the T-top distal to the dispenser head for low pressure application of adhesive material to the outside of the top minor flaps of the moving container and a second stationary multi-orifice nozzle means having a Y-configuration with a top and a base and with aimable nozzles on a side of the Y-top facing the dispenser head for simultaneous low pressure application of adhesive material to the inside of the bottom major flaps of the moving container, said nozzle manifold in heat transfer contact with a passive high heat conductivity metal block, and a heated hot-melt dispenser head connected to the metal block in heat transfer relation, the metal block providing a heat flow path distinct from said manifold from said heated dispenser head to said nozzle manifold.

13. The system of claim 12 wherein the angle of which said nozzles are aimable is in the range of from 60° to 120° relative to the lengthwise direction of said T-top and Y-top of said first and second manifolds.

14. The system of claim 12 wherein each of said aimable nozzles comprises a bolt and a nozzle head, said bolt having a first orifice communicating with a hot-melt in one of said mainfolds and having a plurality of second orifices originating from said first orifice, said nozzle head having a hollow center through which said bolt is placed and a single orifice from said hollow center to the outside, the first orifice, one of said second orifices and the single orifice combining to form a passageway to the outside for hot melt in the one said manifold.

15. The system of claim 12 wherein each of said manifolds have wear bars interspersed between said aimable nozzles.

* * * * *

UNITED STATES PATENT AND TRADEMARK OFFICE

CERTIFICATE OF CORRECTION

PATENT NO. : 4,659,016

DATED : April 21, 1987

INVENTOR(S) : W. Harrison Faulkner, III.

It is certified that error appears in the above—identified patent and that said Letters Patent is hereby corrected as shown below:

Column 1, lines 8-10, "No. 493 710 filed May 11, 1983 now U.S. Pat. No. 4,602,741." should read - -No. 707,892 filed February 22, 1985 now U.S. Pat. No. 4,602,741, which is a file wrapper continuation of Ser. No. 493,710 filed May 11, 1983, now abandoned.

Column 2, line 10, "are replaceable Interspersed" should read - -are replaceable. Interspersed- -.

Column 2, line 37, "with associated coupling" should read - -with associated coupling.- -.

Column 2, line 40, "having two nozzle tips" should read - -having two nozzle tips.- -.

Column 4, line 50, "The swivel nut conneection" should read - -The swivel nut connection- -.

Column 6, lines 12-13, "bottom-apply eembodiments" should read - -bottom-apply embodiments- -.

Claim 1, column 6, line 55, "from 60 to 120" should read - -from 60° to 120°- -.

Claim 3, column 6, lines 60-61, "the aimable noz+les" should read - -the aimable nozzles- -.

Claim 4, column 6, line 64, "said manifold is perendicular" should read - -said manifold is perpendicular- -.

UNITED STATES PATENT AND TRADEMARK OFFICE

CERTIFICATE OF CORRECTION

PATENT NO. : 4,659,016

DATED : April 21, 1987

INVENTOR(S) : W. Harrison Faulkner, III

It is certified that error appears in the above—identified patent and that said Letters Patent is hereby corrected as shown below:

Claim 5, column 6, line 67, "is formed of bard" should read - -is formed of bars- -.

Claim 10, column 7, lines 51-52, "from said first profoce. saod nozzle head" should read - -from said first orifice, said nozzle head- -.

Claim 12, column 8, lines 17-18, "having an inverted T-condigura-tion" should read - -having an inverted T-configuration- -.

Signed and Sealed this

Twenty-ninth Day of September, 1987

*Attest:*

DONALD J. QUIGG

*Attesting Officer*

*Commissioner of Patents and Trademarks*